US008147939B2

(12) United States Patent
Horio et al.

(10) Patent No.: US 8,147,939 B2
(45) Date of Patent: Apr. 3, 2012

(54) ARTIFICIAL GRASS GRANULATED INFILL AND ARTIFICIAL GRASS STRUCTURE USING THE SAME

(75) Inventors: Takashi Horio, Kobe (JP); Hideyuki Okuyama, Kobe (JP); Takeshi Ishmaru, Kobe (JP); Yoshimichi Tanaka, Kobe (JP)

(73) Assignee: Sumitomo Rubber Industries Ltd., Kobe (JP)

( * ) Notice: Subject to any disclaimer, the term of this patent is extended or adjusted under 35 U.S.C. 154(b) by 337 days.

(21) Appl. No.: 12/423,350

(22) Filed: Apr. 14, 2009

(65) Prior Publication Data

US 2009/0286017 A1 Nov. 19, 2009

(30) Foreign Application Priority Data

May 13, 2008 (JP) ..... 2008-125558

(51) Int. Cl.
*B29C 47/00* (2006.01)
*A41G 1/00* (2006.01)

(52) U.S. Cl. ..... 428/36.9; 428/17; 428/36.8

(58) Field of Classification Search ..... 428/15, 428/17–18, 36.8, 36.9
See application file for complete search history.

(56) References Cited

U.S. PATENT DOCUMENTS

| | | | | |
|---|---|---|---|---|
| 3,390,044 | A * | 6/1968 | Malakoff | 428/17 |
| 4,356,220 | A * | 10/1982 | Benedyk | 428/17 |
| 4,735,825 | A * | 4/1988 | Friedrich | 427/202 |
| 7,060,334 | B2 * | 6/2006 | Stroppiana | 428/17 |
| 7,585,555 | B2 * | 9/2009 | Stroppiana | 428/95 |

FOREIGN PATENT DOCUMENTS

| | | | |
|---|---|---|---|
| JP | 9-53204 | A | 2/1997 |
| JP | 9-242011 | A | 9/1997 |
| JP | 2000-17605 | A | 1/2000 |
| JP | 2005-226234 | A | 8/2005 |

* cited by examiner

*Primary Examiner* — Cathy Lam
(74) *Attorney, Agent, or Firm* — Birch, Stewart, Kolasch & Birch, LLP

(57) ABSTRACT

The present invention provides an artificial grass granulated infill excellent in productivity, workability, and recyclability, and an artificial grass structure using the same. A hollow cylindrical granulated infill 5 which has a height h of 3.0 mm or less and an outside diameter of 3.0 mm or less and satisfies the condition: $\phi 2/\phi 1$=0.40 to 0.85, where $\phi 1$ presents the outside diameter and $\phi 2$ represents the inside diameter, is made from a material comprising a synthetic resin having a hardness of 60 or more in accordance with JIS-K6253 type A.

4 Claims, 1 Drawing Sheet

(2.8−1.2)*1.2+2.8*1.2=5.28
(0.8*0.8/2)*4=1.28

Porosity = 1.28/(5.28+1.28) = 0.20 = 20%

ARTIFICIAL GRASS GRANULATED INFILL AND ARTIFICIAL GRASS STRUCTURE USING THE SAME

CROSS-REFERENCE TO RELATED APPLICATIONS

The present application is based on, and claims priority from, Japanese Application Serial Number JP2008-125558, filed May 13, 2008, the disclosure of which is hereby incorporated by reference herein in its entirety.

TECHNICAL FIELD

The present invention relates to an artificial grass granulated infill to be placed between the piles of an artificial grass, and more particularly to an artificial grass granulated infill excellent in productivity, workability, and recyclability.

BACKGROUND ART

A long pile artificial grass comprises a primary backing, piles longer than those of a usual artificial grass implanted on the primary backing, and a infill placed between the piles, and it has spread through various athletic-sports facilities as an artificial grass surface having elastic properties close to natural grass.

An elastic granulated infill of a granulated rubber (a crushed article of a waste tire or industrial rubber) or a thermoplastic elastomer (an EPDM or PE-based elastic resin) is used as a infill for a long pile artificial grass as shown, for example, in Japanese Patent Application Publication No. 2002-294620.

However, the conventional infill has had the following problems. Specifically, the conventional elastic granulated infill has a hardness as low as 40 to 65 in accordance with Japan Industrial Standard (JIS)-K6253 type A. For this reason, when 500 to 1,000 kg of the granulated infill is bagged as one lot and carried to a site at the time of construction, a phenomenon called blocking occurs in which the granulated infill adheres to each other under its own weight to form a lump.

Therefore, the granulated infill agglomerated into a lump at the time of construction has been loosened again and placed between the piles. Further, it is actually difficult to completely loosen the granulated infill agglomerated into a lump, and a infill lump agglomerated into a small lump not only disturbs uniform spraying or filling of the pile, but may affect elastic properties.

Also by the tread pressure applied by a user or equipment after laying and filling, infills may cause a blocking phenomenon in which the infills are joined together. This may compact the artificial grass surface and change the elastic properties of the artificial grass.

As another problem, it is necessary to replace the artificial grass structure with a new artificial grass after the elapse of a certain lifetime. Although the used artificial grass is removed after recovering the infills and then is disposed of as industrial waste, it is not environmentally desirable to dispose of it only as industrial waste.

Under these circumstances, there has recently been proposed an artificial grass-recycling technology in which part of the artificial grass is reused. For example, Japanese Patent Application Publication No. H09-242011 shows an embodiment in which a recovered artificial grass is smoothly recycled into a raw material by using an artificial grass made of a recyclable nylon 6. Japanese Patent Application Publication No. 2000-17605 shows an embodiment in which the artificial grass itself is recycled as a recycling raw material by fixing the pile to the primary backing using a thermoplastic resin.

However, Japanese Patent Application Publication Nos. H09-242011 and 2007-17605 are both premised on completely removing the placed granulated infill from the artificial grass. For this reason, it is not taken into consideration that the granulated infill gets wet with time or is stepped on and hardened, and it is almost impossible to completely remove the granulated infill entering the pile.

From a viewpoint of recycling, the elastic granulated infill is an impurity composed of a material different from the artificial grass. In order to solve the problem for recycling the granulated infill, there is considered a method in which the same material as that composing the infill is used for composing the artificial grass. Material recycling is possible by using this method because even if the granulated infill is left behind between the piles of the artificial grass, the granulated infill and the artificial grass can be treated as those composed of the same material.

However, even if they are produced by using the same material, there are still following problems. That is, when the recycled artificial grass is actually melted and mixed, the recycled article will be very hard and not as elastic as rubber. Therefore, even when it is formed into a granule and placed in the artificial grass, it has been impossible to create the softness close to natural grass which the long pile artificial grass originally has.

Thus, in order to solve the problems mentioned above, the present invention provides an artificial grass granulated infill excellent in productivity, workability, and recyclability, and an artificial grass structure using the same.

SUMMARY OF THE INVENTION

In order to achieve the object mentioned above, the present invention has several features as shown below. According to the invention set forth in claim 1, an artificial grass granulated infill to be placed between the piles of an artificial grass is made from a material comprising a synthetic resin having a hardness of 60 or more in accordance with JIS-K6253 type A, wherein the granulated infill has a hollow cylindrical shape, and the cylinder satisfies the conditions: $h \leqq 3.0$ mm, $\phi 1 \leqq 3.0$ mm, and $\phi 2/\phi 1 = 0.40$ to 0.85, wherein h represents the height (length in the axis direction) of the cylinder; $\phi 1$ represents the outside diameter of the cylinder; and $\phi 2$ represents the inside diameter of the cylinder.

According to this, the granulated infill is made from a material comprising a synthetic resin having a hardness of 60 or more in accordance with JIS-K6253 type A, wherein the granulated infill has a hollow cylindrical shape, and the cylinder satisfies the conditions: $h \leqq 3.0$ mm, $\phi 1 \leqq 3.0$ mm, and $\phi 2/\phi 1 = 0.40$ to 0.85, where h represents the height of the cylinder; $\phi 1$ represents the outside diameter of the cylinder; and $\phi 2$ represents the inside diameter of the cylinder. As a result, a infill having good elasticity can be obtained, and recyclability after use of the same is also good.

As a more specific effect, a hardness of the material of 60 or more substantially prevents a blocking phenomenon in which granulated infills adhere to each other to be agglomerated into a lump. A hardness of less than 60 is not preferred because it develops a blocking phenomenon in which granulated infills adhere to each other.

Further, since the granulated infill has a cylindrical shape, it is hardly plastically deformed even if it is repeatedly deformed by external force, and the elasticity thereof is maintained after an artificial grass is filled with the infill. In addition, since the granulated infill has a cylindrical surface, it hardly causes scratches even if the skin is rubbed against it.

Since the granulated infill is formed to satisfy the following conditions: $h \leqq 3.0$ mm and $\phi 1 \leqq 3.0$ mm, when an artificial grass is filled with it, it fits well into the grain of the grass and will be hardly kicked out with spikes or the like.

Since the granulated infill is formed to satisfy the following condition: $\phi 2/\phi 1 = 0.40$ to 0.85, the cylinder has a porosity of 16 to 73%. As a result, even when deformation stress is applied to the granulated infill, it will have enough energy to absorb the deformation and will have a low repulsive energy, which allows it to maintain suitable elasticity.

As a more preferred embodiment, the granulated infill has a true specific gravity of 1.1 or more, which prevents the granulated infill from being scattered or carried away by wind and rain when the infill is exposed to them after an artificial grass is filled with it.

The present invention also includes an artificial grass structure with the artificial grass granulated infill according to claim 1 or 2 placed between the piles thereof.

DETAILED DESCRIPTION

Figure 1:
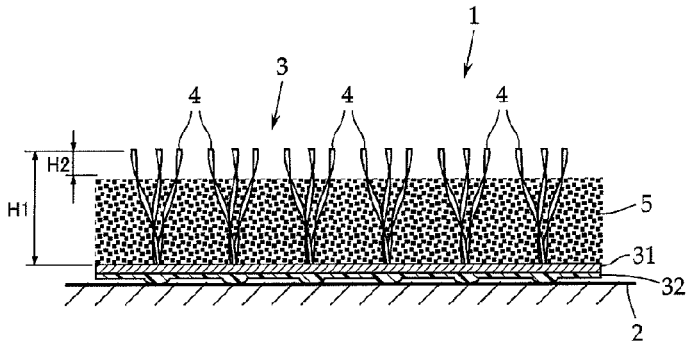
FIG. 1 is a sectional view showing a major portion of an artificial grass structure using an artificial grass granulated infill according to one embodiment of the present invention.
Figure 2:
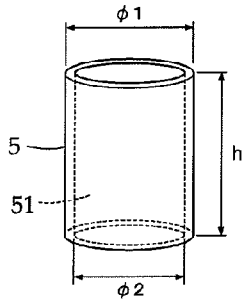
FIG. 2 is a schematic perspective view showing an artificial grass granulated infill.

Next, the embodiments of the present invention will be described referring to the drawings, but the present invention is not limited to them. FIG. 1 is a sectional view showing a major portion of an artificial grass structure filled with the artificial grass granulated infill according to one embodiment of the present invention. FIG. 2 is a schematic perspective view of the artificial grass granulated infill.

As shown in FIG. 1, this artificial grass structure 1 has an artificial grass 3 laid on a base 2, and a granulated infill 5 is placed between piles 4 of the artificial grass 3. In this embodiment, a low cost road pavement surface in which a ground surface is leveled evenly is used as the base 2. However, the ground may be covered with gravel or the like in addition to the above, or an existing pavement surface paved with asphalt or the like may also be used.

Further, an elastic pavement or the like may be provided on the base 2. In the present invention, the structure of the base 2 can be changed depending on specification and is an arbitrary matter.

The artificial grass 3 comprises a primary backing 31 and a pile 4 implanted therein with a predetermined interval. A material for the primary backing 31 is preferably selected from a thermoplastic resin such as polypropylene and polyethylene, but low density polyethylene with good meltability is more preferred in consideration of recyclability.

Although a plain-weave cloth made of a synthetic resin such as polypropylene and polyethylene is used for the primary backing 31 in this embodiment, a cotton-like material of a synthetic resin may be planted in a plain-weave cloth by punching in addition to this. Note that, although the color of the primary backing 31 is arbitrarily determined depending on specification, the primary backing is preferably colored in a color other than black so that it does not easily absorb solar heat when it is remade into a granulated infill.

The pile 4 is preferably a so-called long pile having a pile length H1 from the surface of the primary backing 31 to the tip thereof of from 40 to 75 mm. A material for the pile 4 is preferably selected from thermoplastic resins such as polypropylene and polyethylene, but low density polyethylene with good meltability is more preferred in consideration of recyclability. Although the pile 4 is colored in green, arbitrary colors other than black can be used.

A bundle of a plurality of monotape yarns or monofilament yarns, or a band of split yarn may be used for the pile 4. In this embodiment, the pile 4 has a size of 8,000 to 11,000 dtex and is planted in the primary backing 31 in a planting amount of 1,000 to 2,000 g/m$^3$.

In order to prevent the tufted pile 4 from being dropped off, a coating material 32 is uniformly applied to the back of the primary backing 31. A thermosetting resin such as SBR latex or polyurethane is used for the coating material 32, and an extender such as calcium carbonate is optionally added thereto.

In this embodiment, the coating material 32 is uniformly applied so that the coating amount is from 600 to 800 g/m$^2$ (after drying). The coating material 32 is preferably colored in a color other than black in consideration of the color of the granulated infill that will be exhibited thereby when it is recycled.

In the present invention, the primary backing 31 and the pile 4 are composed of a thermoplastic resin which is easily melted by heating such as polypropylene and polyethylene in consideration of recyclability, but a thermosetting resin such as SBR latex is used for the coating material 32 in consideration of workability and the like.

That is, the artificial grass 3 is composed of a composite of a thermoplastic resin and a thermosetting resin. Therefore, when the artificial grass 3 is melted by heating, a thermosetting resin is uniformly dispersed in a thermoplastic resin to form a single material in which both resins are mixed with each other. Thus, the present invention is constituted so that the content of a thermoplastic resin is 50% by weight or more of the total amount of the resin including the coating material 32.

That is, a content of a thermoplastic resin of less than 50% by weight of the whole is not preferred because when a thermosetting resin such as a resin for the coating material 32 is contained, it will not be uniformly dispersed in the molten thermoplastic resin and the mixture cannot be treated as a single material.

A material other than a thermosetting resin can be selected for the coating material 32 in consideration of processability, cost, and the like if the material can fix the pile 4 and satisfies the dimensional stability of the artificial grass 3. However, it is more effective to use a relatively soft material such as SBR and polyurethane in order to impart moderate elasticity to the granulated infill 5 at the time of recycling.

This artificial grass 3 is filled with the granulated infill 5 as a infill. The granulated infill 5 is made from a material comprising a synthetic resin having a hardness of 60 or more in accordance with JIS-K6253 type A, which is obtained by suitably blending an elastomer having elasticity such as EPDM, EVA, and SBR with a thermoplastic resin such as polypropylene, polyethylene, and polyethylene terephthalate.

When both the resin and the elastomer are thermoplastic, they can be homogenized by stirring and mixing while heating the both. When the elastomer is thermosetting, finely divided elastomer particles may be added to a heated and molten resin to be uniformly dispersed, and the composition and the production method thereof may be arbitrarily selected as long as a material having a hardness of 60 or more can be obtained.

According to this, a hardness of a material of 60 or more substantially prevents a blocking phenomenon in which granulated infills adhere to each other to be agglomerated into a lump.

Referring also to FIG. 2, the granulated infill 5 is formed into a hollow cylindrical shape having a predetermined void 51 along the axis direction. According to this, since the granulated infill has a cylindrical shape, it is hardly plastically deformed even if it is repeatedly deformed by external force, and elasticity thereof is maintained even after an artificial grass is filled with it. In addition, since the granulated infill has a cylindrical surface, it hardly causes scratches or the like even if skin is rubbed against it.

When h represents the height (length in the axis direction) of the granulated infill 5 and $\phi 1$ represents the outside diameter thereof, the granulated infill 5 preferably has a height h of 3.0 mm or less and an outside diameter $\phi 1$ of 3.0 mm or less, more preferably $1.0\ \text{mm} \leqq h \leqq 3.0\ \text{mm}$ and $1.0\ \text{mm} \leqq \phi 1 \leqq 3.0\ \text{mm}$, as a preferred embodiment. According to this, when an artificial grass is filled with it, the granulated infill fits well into the grain of the grass and will be hardly kicked out with spikes or the like.

Specifically, when both the height h and the outside diameter $\phi 1$ are less than 1.0 mm, the granulated infill 5 is so small that it will be easily scattered by wind and rain and kicking. Therefore, this is not preferred. Further, when both the height h and the outside diameter $\phi 1$ are more than 3.0 mm, the granulated infill 5 is so large that it will be placed between the piles only unsatisfactorily. Therefore, this is also not preferred.

Furthermore, when the inside diameter of the granulated infill 5 is represented by $\phi 2$, the granulated infill is formed into a hollow cylindrical shape satisfying the following condition: $\phi 2/\phi 1 = 0.40$ to 0.85. According to this, the granulated infill 5 has a porosity of 16 to 73%. As a result, even when deformation stress is applied to the granulated infill, it will have enough energy to absorb the deformation and will have a low repulsive energy, which allows it to maintain suitable elasticity.

Specifically, when $\phi 2/\phi 1$ is less than 0.40, the porosity is so low that the elasticity will be reduced. Therefore, this is not preferred. On the contrary, when $\phi 2/\phi 1$ is more than 0.85, the porosity is so high that the granulated infill 5 will be easily plastically deformed when a load is applied thereto. Therefore, this is also not preferred.

In addition, the granulated infill 5 preferably has a true specific gravity of 1.1 or more. That is, if it has a true specific gravity of less than 1.1, it will be not only easily carried away by wind and rain, but will be easily kicked out or scattered during the game of soccer or the like.

Thus, the granulated infill 5 is adjusted so that it has a specific gravity of 1.1 or more. An example of the method for increasing the specific gravity includes a method of adding an additive such as calcium carbonate, but the specific gravity may be increased by any method other than this.

A method for producing the granulated infill 5 includes heating and melting a raw material, injection-molding the molten raw material into a mold to form a hollow tube, and cutting the tube into a predetermined length to form a cylinder. However, any method for producing the granulated infill may be employed as long as it satisfies the conditions mentioned above.

In this embodiment, the granulated infill 5 consists of a new mixture of the thermoplastic resin and elastomer which are mentioned above. However, in addition to this, it may be formed from a recycled article prepared by remelting the used waste artificial grass 3 and molding the melt into granules as long as it satisfies the conditions mentioned above.

The granulated infill 5 preferably consists of a single type of granulated infill. Specifically, if the granulated infill 5 consists of a mixture of plural types of granulated infills, the infill must be classified for every type after it is removed from an artificial grass when it is removed from a used artificial grass and placed again in an artificial grass which is newly laid. In addition, the proportion of the types of infill removed from the artificial grass 3 may not be uniform. Therefore, there is a risk that an artificial grass structure having the same properties as those before recycling may not be obtained by the refilling.

The granulated infill 5 is preferably colored in a predetermined color, and more preferably colored in a color other than black. According to this, it is possible not only to obtain an aesthetic appearance close to an artificial grass or the ground, but is possible to prevent a buildup of heat by absorbing sunlight, by coloring the granulated infill 5 in a green-based color or a brown-based color, for example. For this purpose, the pile, primary backing, and coating material which constitute the artificial grass used as a material are preferably colored in a color other than black.

The filling thickness of the granulated infill 5 is arbitrarily selected by the elasticity demanded, but the thickness is preferably selected so that the projection height H2 of the pile 4 (the length from the top of the layer filled with the granulated infill to the tip of the pile) is from 10 to 30 mm in order to prevent an outflow or scattering of the granulated infill 5.

According to the present invention, the artificial grass can be recycled as a material for the artificial grass application to establish a circulating type recycling system by recovering the used artificial grass 1 from a roadbed, heating and melting it, forming the melt into a granulated infill, and then placing the recycled granulated infill again as a granulated infill for an artificial grass newly laid on a roadbed.

Hereinafter, Examples 1 to 3 of the present invention and Comparative Examples 1 to 4 will be described. First, the artificial grass and the granulated infill were prepared by the following methods.

(Preparation of Artificial Grass)

A split yarn made of low density polyethylene (size: 11,000 dtex) was implanted in a primary backing made of polypropylene (weight: 100 g/m$^2$) by tufting in a mass per unit area of 1000 g/m$^2$ so that the yarn forms a grass having a length of 50 mm. A latex prepared from a mixture of SBR and calcium carbonate (mixing ratio, SBR:calcium carbonate=1:2) was applied to the back side of the primary backing as a coating material, and then the latex was dried to produce an artificial grass.

Since the product weight at this time was 1,850 g/m$^2$, it was determined that the dry weight of the coating material was 750 g/m$^2$ (250 g/m$^2$ of SBR:500 g/m$^2$ of calcium carbonate).

(Preparation of Granulated Infill)

High density polyethylene (HDPE) was blended with an olefinic thermoplastic elastomer (product number: VG9700Q, manufactured by Riken Technos Corporation) in a blending ratio of 30:70 followed by heating and mixing. The heated mixture was extruded from a nozzle into the shape of a string, which was cut to prepare a granulated infill. The shape of the nozzle was changed to prepare each of the granulated infill for each of Examples 1 to 3 and Comparative Examples 1 to 4.

(Construction of Sample Grass)

The above artificial grass (with a grass length of 50 mm) in a size of 1 m×1 m was laid on a roadbed and then filled with 10 kg (an average thickness of 30 mm) of each of the granulated infills in Examples 1 to 2 and Comparative Examples 1 to 3 to prepare a sample grass, which was then subjected to each of the following evaluations.

(Measurement and Evaluation of Hardness)

Each of the samples in Examples 1 to 3 and Comparative Examples 1 to 4 was injection-molded into a cylindrical shape having a size of ϕ30 mm×H 10 mm, followed by measuring hardness in accordance with JIS-K6253 type A.

(Evaluation of Shock Absorption)

Each of the samples in Examples 1 to 3 and Comparative Examples 1 to 4 was subjected to an shock test stipulated in DIN 18032 to evaluate shock absorption (elasticity). The measurement was performed 5 times at the same measurement conditions, and then the deformed state of the granulated infill at the time of the measurement was observed.

The results of the measurements are shown below.

Example 1

Sectional shape: Cylindrical
Outside diameter ϕ1: 2.8 mm
Inside diameter ϕ2: 1.2 mm
Inside diameter ϕ2/outside diameter ϕ1: 0.43
Height h: 2.8 mm
Porosity: 18.4%
Hardness: 61
Shock absorption: 51
Plastic deformation: No Example 2

Sectional shape: Cylindrical
Outside diameter ϕ1: 2.8 mm
Inside diameter ϕ2: 2.4 mm
Inside diameter ϕ2/outside diameter ϕ1: 0.857
Height h: 2.8 mm
Porosity: 73.5%
Hardness: 62
Shock absorption: 54
Plastic deformation: No Example 3

Sectional shape: Cylindrical
Outside diameter ϕ1: 2.8 mm
Inside diameter ϕ2: 2.3 mm
Inside diameter ϕ2/outside diameter ϕ1: 0.82
Height h: 2.8 mm
Porosity: 67.5%
Hardness: 60
Shock absorption: 52
Plastic deformation: No Comparative Example 1

Figure 3:
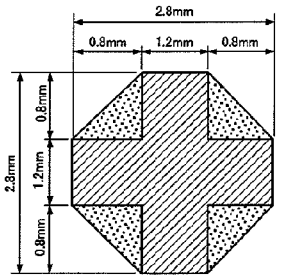
FIG. 3 (PRIOR ART)
FIG. 3 is an explanatory view illustrating the void and a method for calculating the porosity of Comparative Example 3.

Sectional shape: Cross-shaped
Outside diameter ϕ1:-
Inside diameter ϕ2:-
Inside diameter ϕ2/outside diameter ϕ1:-
Height h: 2.8 mm
Porosity: 20% (refer to FIG. 3 for a method for calculating the porosity)
Hardness: 61
Shock absorption: 52
Plastic deformation: Yes (pain is experienced when skin is rubbed)

Comparative Example 2

Sectional shape: Cylindrical
Outside diameter ϕ1: 2.8 mm
Inside diameter ϕ2: 1.0 mm
Inside diameter ϕ2/outside diameter ϕ1: 0.36
Height h: 2.8 mm
Porosity: 12.8%
Hardness: 62
Shock absorption: 40
Plastic deformation: No Comparative Example 3

Sectional shape: Cylindrical
Outside diameter ϕ1: 2.8 mm
Inside diameter ϕ2: 2.6 mm
Inside diameter ϕ2/outside diameter ϕ1: 0.93
Height h: 2.8 mm
Porosity: 86.2%
Hardness: 62
Shock absorption: 46
Plastic deformation: Yes Comparative Example 4

Sectional shape: Cylindrical
Outside diameter ϕ1: 2.8 mm
Inside diameter ϕ2: 2.3 mm
Inside diameter ϕ2/outside diameter ϕ1: 0.82
Height h: 3.2 mm
Porosity: 67.5%
Hardness: 61
Shock absorption: 52
Plastic deformation: No Table 1 summarizes the properties and evaluation results of the infills in Examples 1 to 3 and Comparative Examples 1 to 4.

TABLE 1

| | Example 1 | Example 2 | Example 3 | Comparative Example 1 | Comparative Example 2 | Comparative Example 3 | Comparative Example 2 |
|---|---|---|---|---|---|---|---|
| Granular filler shape | | | | | | | |
| Outside diameter (mm) | 2.8 | 2.8 | 2.8 | — | 2.8 | 2.8 | 2.8 |

TABLE 1-continued

| | Example 1 | Example 2 | Example 3 | Comparative Example 1 | Comparative Example 2 | Comparative Example 3 | Comparative Example 2 |
|---|---|---|---|---|---|---|---|
| Inside diameter (mm) | 1.2 | 2.4 | 2.3 | — | 1.0 | 2.6 | 2.3 |
| Inside diameter/ Outside diameter | 0.43 | 0.857 | 0.82 | — | 0.36 | 0.93 | 0.82 |
| Height (mm) | 2.8 | 2.8 | 2.8 | 2.8 | 2.8 | 2.8 | 2.8 |
| Porosity (%) | 18.4 | 73.5 | 67.5 | 20.0 | 12.8 | 86.2 | 67.5 |
| Hardness | 61 | 62 | 60 | 61 | 62 | 62 | 61 |
| Shock absorption | 51 | 54 | 52 | 52 | 40 | 46 | 52 |
| Plastic deformation | NO | NO | NO | YES | NO | YES | NO |

The following findings have been obtained as a result of comparing the infills in Examples with those in Comparative Examples.

(1) Since the granulated infill in Comparative Example 1 is not cylindrical, the granulated infill after testing is plastically deformed. In addition, since the granulated infill has sharp edges, pain will be experienced when the skin is rubbed against the granulated infill after an artificial grass is filled with it.

(2) The granulated infill in Comparative Example 2 has an inside diameter ϕ2/outside diameter ϕ1 of 0.36 and a porosity of 12.8%. The low porosity causes reduction in shock absorption.

(3) The granulated infill in Comparative Example 3 has an inside diameter ϕ2/outside diameter ϕ1 of 0.93 and a porosity of 86.2%. The porosity is so high that the granulated infill has poor shock absorption and shows plastic deformation.

(4) The granulated infill in Comparative Example 4 is significantly scattered after the shock absorption test.

The invention claimed is:

1. An artificial grass granulated infill to be placed between piles of an artificial grass, the granulated infill being made from a material comprising a synthetic resin having a hardness of 60 or more in accordance with Japanese Industrial Standard (JIS)-K6253 type A, wherein the granulated infill has a hollow cylindrical shape, and the cylinder satisfies the conditions:

$$h \leqq 3.0 \text{ mm}, \phi 1 \leqq 3.0 \text{ mm}, \text{ and } \phi 2/\phi 1 = 0.40 \text{ to } 0.85$$

wherein h represents the height of the cylinder; ϕ1 represents the outside diameter of the cylinder; and ϕ2 represents the inside diameter of the cylinder.

2. The artificial grass granulated infill according to claim 1, wherein the granulated infill has a true specific gravity of 1.1 or more.

3. An artificial grass structure obtained by placing an artificial grass granulated infill according to claim 1 between the piles thereof.

4. An artificial grass structure obtained by placing an artificial grass granulated infill according to claim 2 between the piles thereof.

* * * * *